US006568980B2

(12) United States Patent
Barthold

(10) Patent No.: US 6,568,980 B2
(45) Date of Patent: May 27, 2003

(54) TOY AIRPLANE POWERED BY ELECTRIC MOTOR AND CAPACITOR POWER SOURCE

(75) Inventor: Mark Barthold, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/779,165

(22) Filed: Feb. 8, 2001

(65) Prior Publication Data

US 2002/0106961 A1 Aug. 8, 2002

(51) Int. Cl.[7] ..... A63H 27/127

(52) U.S. Cl. ..... 446/36; 446/57; 446/63; 446/484

(58) Field of Search ..... 446/34, 46, 56, 446/57, 483, 484, 462, 471; 320/107, 110, 111, 114, 119, 120, 122, 166, 167; 244/53 R, 60, 534; D21/441, 447, 498, 499, 450; D12/330, 332, 333

(56) References Cited

U.S. PATENT DOCUMENTS

| | | | | | |
|---|---|---|---|---|---|
| D127,185 | S | | 5/1941 | Northrop | |
| 3,629,680 | A | * | 12/1971 | Baynes et al. | 320/103 |
| 3,699,708 | A | * | 10/1972 | Mabuchi | 446/57 |
| 3,774,865 | A | | 11/1973 | Pinto | |
| 3,796,005 | A | * | 3/1974 | Chang et al. | 446/484 |
| D245,637 | S | * | 8/1977 | Jewett | D21/450 |
| 4,180,221 | A | | 12/1979 | Harris | |
| 4,563,626 | A | * | 1/1986 | Ohtake | 320/103 |
| 4,591,111 | A | | 5/1986 | Laughter | |
| 4,636,178 | A | * | 1/1987 | Oda | 446/462 |
| 5,046,979 | A | * | 9/1991 | Ragan et al. | 244/54 |
| 5,087,000 | A | | 2/1992 | Suto | |
| 5,090,636 | A | | 2/1992 | Sadowski | |
| 5,214,369 | A | * | 5/1993 | McCrea | 320/143 |
| 5,334,076 | A | * | 8/1994 | Shinozuka | 320/111 |
| 5,634,839 | A | | 6/1997 | Dixon | |
| 5,672,086 | A | | 9/1997 | Dixon | |
| 5,932,992 | A | * | 8/1999 | Tomatsu et al. | 320/103 |
| 6,097,112 | A | * | 8/2000 | Kondo | 307/125 |

* cited by examiner

*Primary Examiner*—S. Thomas Hughes
*Assistant Examiner*—Alex F. R. P. Rada, II
(74) *Attorney, Agent, or Firm*—Roy A. Ekstrand

(57) ABSTRACT

A toy airplane includes a flying wing body having a capacitor-powered electric motor propulsion apparatus supported within the body. A charging receptacle is formed in the airplane body and supports electrical contacts which in turn are coupled to the propulsion unit. A separate battery-powered charger includes a charger head insertable into the receptacle to transfer energy from internal batteries within the charger to the capacitor power unit of the airplane. A launcher button operates a normally closed switch to decouple the motor from the propulsion unit during the charging process.

4 Claims, 2 Drawing Sheets

FIG. 3
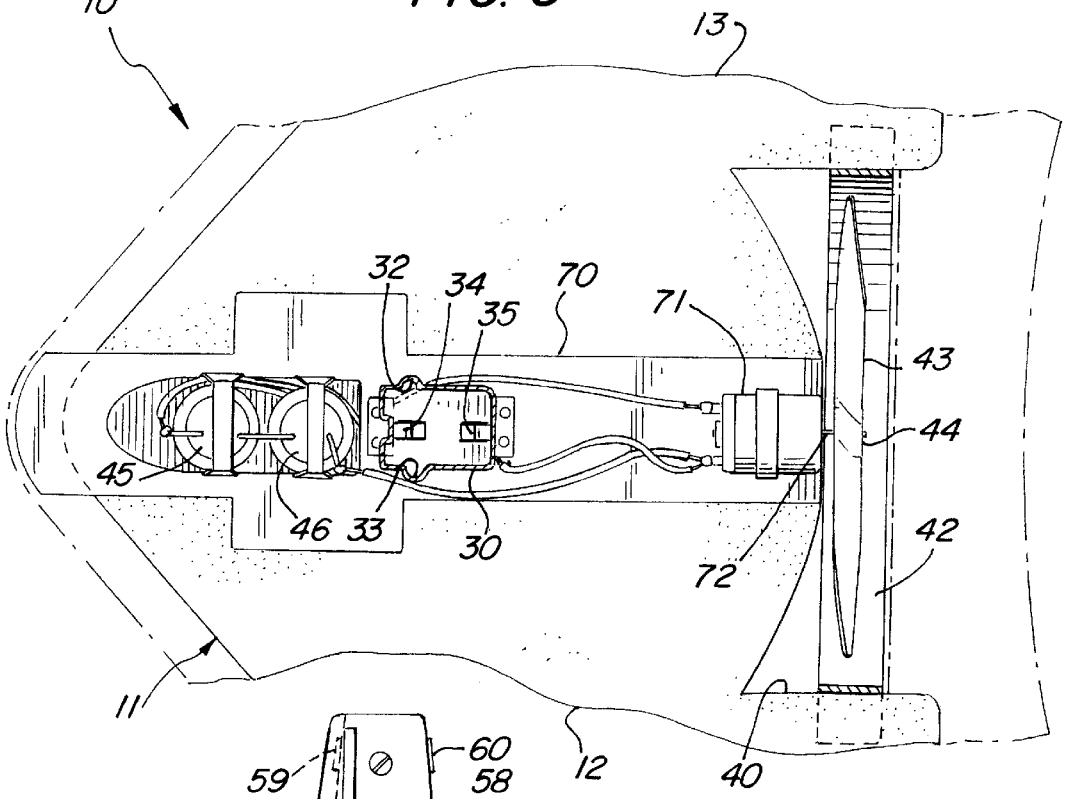
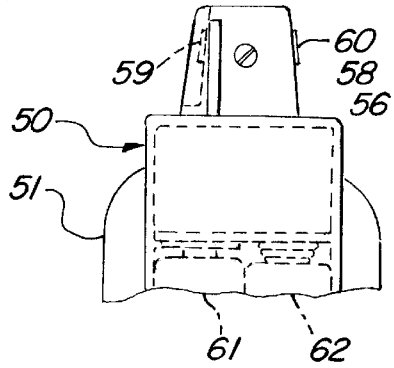
FIG. 4
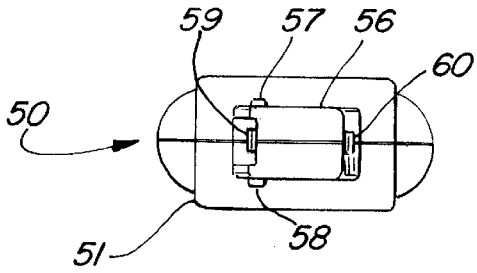
FIG. 5
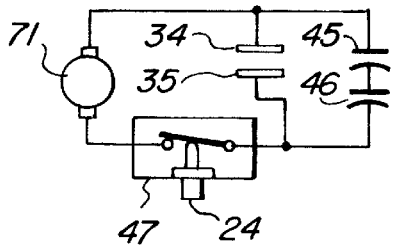
FIG. 6

TOY AIRPLANE POWERED BY ELECTRIC MOTOR AND CAPACITOR POWER SOURCE

FIELD OF THE INVENTION

This invention relates generally to toy and/or model airplanes and particularly to the power sources used therein.

BACKGROUND OF THE INVENTION

Toy airplanes, often also referred to as model airplanes, have enjoyed an extremely long-lasting and extensive popularity among children and adults for many years. In fact, small scale model gliders actually preceded the initial development of powered aircraft.

The continuous development of toy or model airplanes has included the development of serious small scale aircraft used to study aircraft design and flight characteristics as well as small scale self-powered toy or model airplanes intended for amusement and entertainment. In addition, remotely controlled aircraft using either a controlling tether or radio signal transmission link has further improved the realism and enjoyment of toy and model airplanes. It will be noted that any distinction between toy or model airplanes in connection with the present invention is, in essence, a distinction without a difference. Thus, such small scale toy and/or model airplanes particularly those capable of flight will be referred to herein collectively and "toy airplanes".

The majority of toy airplanes capable of flight utilize one or more small internal combustion engines driving one or more propellers. While small scale internal combustion engines and propeller drive apparatus have provided substantial power and speed in small scale toy aircraft, there are significant difficulties of handling and use which tend to prevent young children from utilizing such flying toy aircraft.

Notsurprisingly, the continued popularity of toy airplanes has prompted practitioners in the art to create and provide a virtually endless variety of toy airplanes. For example, U.S. Pat. No. 4,180,221 issued to Harris sets forth a SELF-PROPELLED KITE having a frame and stringer arrangement supporting a generally V-shaped wing. A propeller driven by a small internal combustion engine provides a propulsion source for the craft while a rudder with rudder control situated rearward of the propeller provides for maneuverability.

U.S. Pat. No. 4,591,111 issued to Laughter sets forth a THERMAL NAVIGATOR for use in an ultra-light aircraft, glider or sail plane. The apparatus functions to detect and navigate within thermal updrafts and utilizes a right and left temperature sensor pair mounted on the wings of the aircraft. A difference circuit and difference indicator measures and indicates temperature differences between the right and left wings allowing the aircraft to respond to localized air temperatures and track thermal currents.

U.S. Pat. No. 5,087,000 issued to Suto sets forth a TOY AIRPLANE having an airframe supporting a fixed vertical tail plane, a fixed horizontal tail plane and at least one set of right side and left side propellers. The rotational outputs of the propellers are controlled discretely and continuously or in a staged manner via a remotely located radio transmitter. By independently controlling the propellers, the flight of the toy airplane is controlled.

U.S. Pat. No. 5,672,086 issued to Dixon sets forth an AIRCRAFT HAVING IMPROVED AUTO ROTATION AND METHOD FOR REMOTE CONTROLLING SAME in which a main body portion includes a central hub member and a plurality of wings. Each wing is equally spaced about a central axis of rotation. The toy aircraft further includes a power source carried by the aircraft, at least one motorized propulsion unit interconnected with the power source and at least first and second propeller assemblies interconnected to the propulsion unit. The first and second propeller assemblies include a plurality of blades arranged for rotation in a substantially horizontal plane. A similar craft is set forth in U.S. Pat. No. 5,634,839 also issued to Dixon and entitled TOY AIRCRAFT AND METHOD FOR REMOTELY CONTROLLING SAME which is the parent of U.S. Pat. No. 5,672,086.

U.S. Pat. No. 5,090,636 issued to Sadowski sets forth an AIRCRAFT having a body portion and a pair of wings extending from either side thereof. An upward step is formed in the underside of the body portion at the center of the aircraft and defines a rearwardly facing riser surface. The riser surface extends outwardly toward the wing tips terminating substantially inwardly of the wing tips.

U.S. Pat. No. Des. 127,185 issued to Northrop sets forth an AIRPLANE which includes a flying wing craft having a center cockpit and a pair of rearwardly oriented propeller units.

U.S. Pat. No. 3,774,865 issued to Pinto sets forth a FLYING SAUCER type of aircraft or water vehicle which may take the form of a toy or an actual full-sized passenger and cargo carrying vehicle. The vehicle includes a circular-shaped body having an outer rim and an inner hub portion. Upper and lower groups of rotor helicopter-like blades are formed into a disk-shaped configuration and are rotatable about the center axis of the vehicle.

While the foregoing described prior art devices have to some extent improved the art and in some instances enjoyed commercial success, there remains nonetheless a continuing need in the art for a flying toy airplane which is relatively inexpensive to manufacture and which is convenient and easy to use by young children.

SUMMARY OF THE INVENTION

Accordingly, it is a general object of the present invention to provide an improved toy airplane. It is a more particular object of the present invention to provide an improved propulsion and launching apparatus for a flying toy airplane. It is a further object of the present invention to provide an improved propulsion and launching apparatus which is readily and easily utilized by young children.

In accordance with the present invention, there is provided a toy airplane comprising: an airplane body having wings and defining a charger receptacle; a propulsion unit supported within the airplane body having a motor and propeller rotated by the motor, a capacitor storage unit, a pair of contacts supported within the receptacle and a switch, the contacts being coupled to the capacitor storage unit and the switch having an open condition and a closed condition coupling the motor to the capacitor storage unit in its closed condition and decoupling the motor in its open condition; and a charger unit having a battery power supply and contact means for temporarily connecting to the pair of contacts to transfer energy from the battery power supply to the capacitor storage unit, the switch being opened during charging of the capacitor storage unit to maximize energy transfer between the battery power supply and the capacitor storage unit by decoupling the motor.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

FIG. 3 sets forth a partial section top view of the present invention toy airplane taken along section lines 3—3 in FIG. 1;

FIG. 4 sets forth a partial side elevation view of the charging apparatus of the present invention toy airplane;

FIG. 5 sets forth a top view of the charging apparatus of the present invention toy airplane; and FIG. 6 sets forth a schematic diagram of the charging and motor circuit of the present invention toy airplane.

DESCRIPTION OF THE PREFERRED EMBODIMENT

Figure 1:
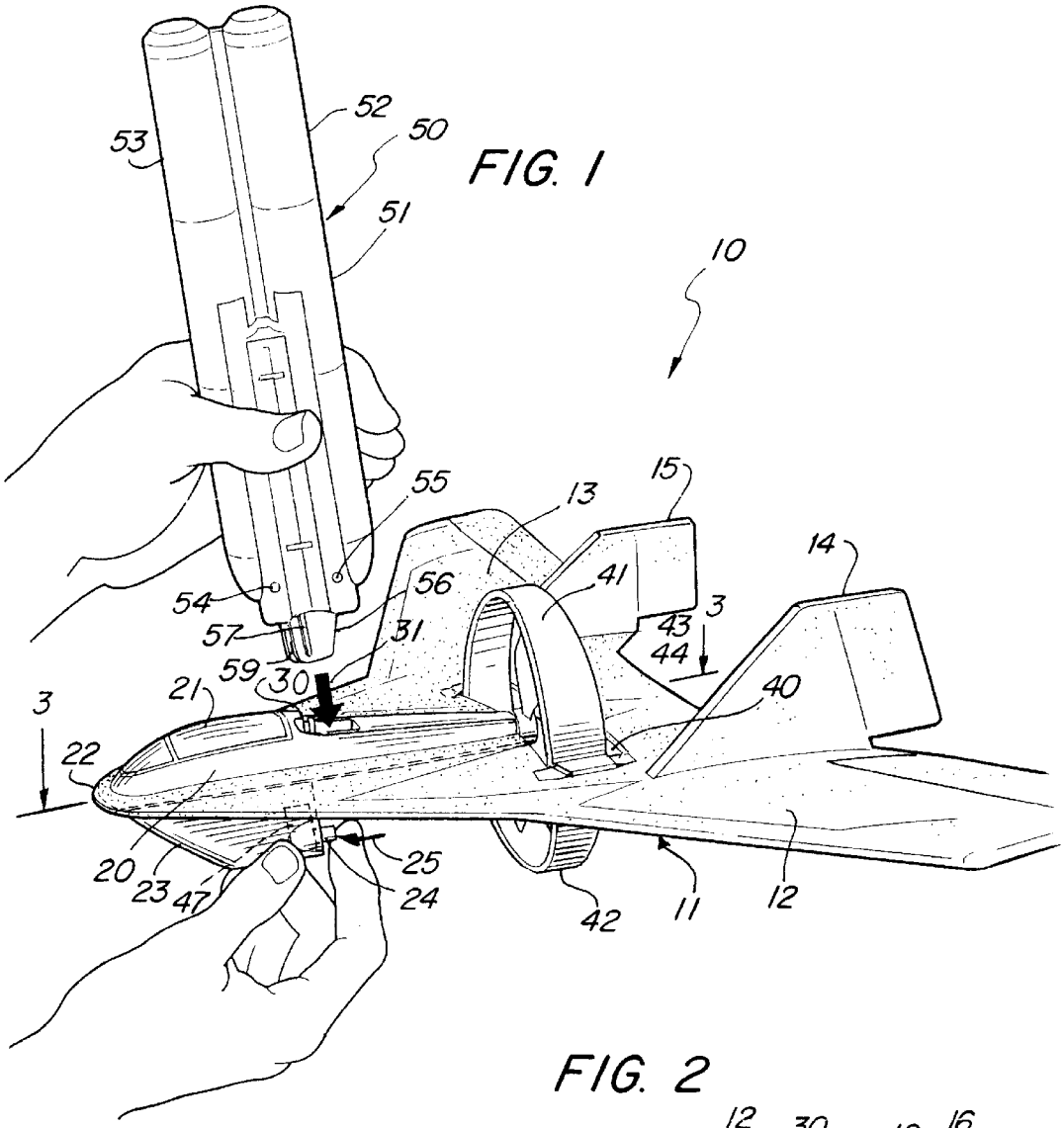
FIG. 1 sets forth a perspective view of a toy airplane and its charging apparatus constructed in accordance with the present invention in preparation for launch.

FIG. 1 sets forth a perspective view of a toy airplane constructed in accordance with the present invention and generally referenced by numeral 10. Toy airplane 10 is shown being held in an appropriate position for recharging the power source therein and accordingly FIG. 1 also shows a charger unit generally referenced by numeral 50 also constructed in accordance with the present invention. In further accordance with the preferred handling of toy airplane 10 and charger 50, toy airplane 10 is being held by the user in one hand while charger unit 50 is being held in the user's other hand to correctly position airplane 10 and charger 50 for the recharging operation described below.

More specifically, toy airplane 10 is fabricated to generally resemble a flying wing and thus defines a body 11 having a pair of wings 12 and 13 together with a pair of vertically extending spaced apart vertical fins 14 and 15. Body 11 further defines a fuselage 20 having a charger receptacle 30 and a cockpit 21 formed therein. Body 11 further includes a downwardly extending landing skid 23 which supports a depressible launcher button 24. Body 11 further defines a transversely extending propeller slot 40 having an upper shroud 41 and a lower shroud 42 supported above and beneath slot 40 respectively. A propeller hub 44 supports a propeller 43 for rotation within upper shroud 41 and lower shroud 42 through slot 40.

In the preferred fabrication of toy airplane 10, body 11 is fabricated of lightweight foam plastic material or the like to provide substantial strength at a minimum weight. The structure of charger receptacle 30 is set forth below in FIG. 3 in greater detail. Suffice it to note here that charger receptacle 30 extends inwardly within fuselage 20 and supports a pair of electrical contacts (contacts 34 and 35 seen in FIG. 3).

Charger 50 is preferably fabricated of a suitable plastic material and includes an elongated housing 51 forming a pair of battery tubes 52 and 53 within a plurality of conventional batteries such as batteries 61 and 62 (seen in FIG. 4) are supported. Charger 50 further supports a pair of indicator elements 54 and 55 which in the preferred fabrication of the present invention comprise light-emitting diodes (LED's) which are operative in the manner described below to indicate charging conditions of toy airplane 10.

In operation, as the user grips toy airplane 10 by grasping landing skid 23 in one hand and positioning an index finger over launcher button 24 as shown in FIG. 1, button 24 is depressed inwardly in the direction indicated by arrow 25. Concurrently, the user aligns charger 50 as shown while holding charger 50 with the user's remaining hand such that charger head 56 is aligned with charger receptacle 30. Thereafter, the user moves charger 50 downwardly in the direction indicated by arrow 31 to insert charger head 56 into charger receptacle 30. The proper positioning of charger head 56 within receptacle 30 is ensured by the one-way keying of receptacle 30 and head 56 shown in FIGS. 3, 4 and 5. This one-way positioning of charger head 56 is provided to ensure that the correct polarity of charging voltage is applied to the internal circuit (seen in FIG. 6) of toy airplane 10.

Once charger head 56 is properly inserted within receptacle 30, electrical power is transferred from charger 50 into a pair of storage capacitors 45 and 46 (seen in FIG. 6) which are housed within fuselage 20. In accordance with the preferred fabrication of the present invention, as the user maintains the inward force upon button 24, the transfer of electrical energy from charger 50 to the storage capacitors within fuselage 20 is maximized and takes place without rotation of propeller 43. As the charging process is initiated, indicator 54 is energized to indicate the transfer of electrical energy from charger 50 to the propulsion unit of toy airplane 10. Once the desired level of charge has been transferred, indicator 54 turns off and indicator 55 turns on. The user then withdraws charger 50 and while maintaining the force upon button 24, positions toy airplane 10 for launch.

Figure 2:
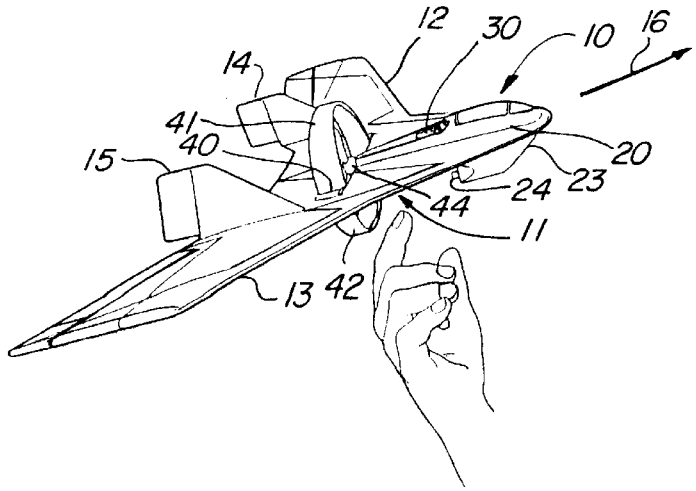
FIG. 2 sets forth a perspective view of a toy airplane constructed in accordance with the present invention following its launch.

FIG. 2 sets forth a perspective view of toy airplane 10 following the launch of the toy airplane by the user. In the position shown in FIG. 2, the above-described charging of toy airplane 10 has been completed and the user has thrust toy airplane 10 upwardly and forwardly in the direction indicated by arrow 16 thereby releasing the user's grip upon skid 23 and releasing pressure upon button 24.

More specifically, toy airplane 10 is fabricated to generally resemble a flying wing and thus defines a body 11 having a pair of wings 12 and 13 together with a pair of vertically extending spaced apart vertical fins 14 and 15. Body 11 further defines a fuselage 20 having a charger receptacle 30 and a cockpit 21 formed therein. Body 11 further includes a downwardly extending landing skid 23 which supports a depressible launcher button 24. Body 11 further defines a transversely extending propeller slot 40 having an upper shroud 41 and a lower shroud 42 supported above and beneath slot 40 respectively. A propeller hub 44 supports a propeller 43 for rotation within upper shroud 41 and lower shroud 42 through slot 40.

With some experimentation, the user will develop in relatively short time the preferred method of launching toy airplane 10. The essential elements of this launch include releasing button 24 which in the manner described below in FIG. 6 initiates the transfers of electrical energy from storage capacitors 45 and 46 to the propulsion motor (motor 71 seen in FIG. 6). There is some element of timing involved in the release of button 24 and the thrusting of airplane 10. In some wind conditions, the user may prefer to initially release button 24 prior to launching airplane 10. Conversely, in different wind conditions, the user may prefer to simultaneous launch toy airplane 10 and allow the natural release of button 24 to occur as toy airplane 10 leaves the user's hands. Of importance with respect to the present invention is the use of the switch (switch 47 seen in FIG. 6) controlled by button 24 to minimize the loss of energy prior to launch and to maximize the speed of charging of toy airplane 10.

Once toy airplane 10 has been launched, the rotation of propeller 43 produces a sustaining thrust which allows toy airplane 10 to fly for a limited amount of time afterwhich the rotation of propeller 43 ceases and toy airplane 10 glides naturally to earth. The entire process may be repeated a virtually endless number of times as the user is able to repeatedly charge the power source within toy airplane 10.

FIG. 3 sets forth a partial section view of toy airplane 10 taken along section lines 3—3 in FIG. 1. As described above, toy airplane 10 includes a flying wing-shaped body 11 having wings 12 and 13 formed integrally therein. As is also described above, body 11 defines a propeller slot 40 supporting a lower shroud 42. In the preferred fabrication of the present invention, a lightweight drive unit housing 70 is supported within body 11 and provides for the support of a small direct current motor 71 having an output shaft 72. Propeller 43 is supported upon shaft 72 by a propeller hub 44. Thus, propeller 43 rotates within slot 40 and upper shroud 41 (seen in FIG. 1) and lower shroud 42. Drive unit housing 70 further supports receptacle 30 which defines a pair of indexing or keying grooves 32 and 33. It will be noted that grooves 32 and 33 are offset from the center of receptacle 30 allowing the above-described one-way positioning of head 56 of charger unit 50 (seen in FIG. 5). Within receptacle 30 a pair of spaced apart electrical contacts 34 and 35 are supported. A pair of capacitors 45 and 46 are also supported within drive unit housing 70 and are operatively coupled to motor 71 and contacts 34 and 35 by conventional electrical wiring to form the electrical circuit shown in FIG. 6.

FIG. 4 sets forth a partial side elevation view of charger unit 50. As described above, charger unit 50 includes a housing 51 supporting a plurality of conventional batteries such as batteries 61 and 62. As is also described above, charger unit 50 includes a charger head 56. Head 56 supports a pair of guide ribs 57 and 58 (rib 57 seen in FIG. 5). Head 56 further supports a pair of electrical contacts 59 and 60.

FIG. 5 sets forth a top view of charger unit 50 which as described above includes a housing 51 and a charger head 56. As is also described above, head 56 supports a pair of offset guide ribs 57 and 58 together with a pair of electrical contacts 59 and 60. By concurrent reference to FIGS. 3, 4 and 5, it will be apparent to those skilled in the art that grooves 32 and 33 of receptacle 30 cooperate with ribs 57 and 58 to ensure that the insertion of head 56 within receptacle 30 is subject to a "one-way" insertion. It will be equally apparent to those skilled in the art by simultaneous reference to FIGS. 3, 4 and 5 that the insertion of head 56 into receptacle 30 places electrical contacts 59 and 60 against contacts 34 and 35 to establish the desired electrical connection between charger 50 and toy airplane 10.

FIG. 6 sets forth a circuit diagram of the propulsion unit of toy airplane 10. A pair of electrical contacts 34 and 35 are coupled to a pair of series connected capacitors 45 and 46. Capacitors 45 and 46 are preferably fabricated of sufficient capacity to provide storage of substantial electrical energy. A motor 71 is coupled to contact 34 and to a normally closed switch 47. The remaining side of switch 47 is coupled to electrical contact 35.

In operation, the above-described charging process takes place as the user presses button 24 and inserts charger head 56 into receptacle 30 (seen in FIG. 1). The pressing of button 24 in the manner shown in FIG. 1 opens normally closed switch 47. As a result, the electrical connection established between the battery-powered units of charger 50 (seen in FIG. 1) and contacts 34 and 35 causes electrical energy to be stored within capacitors 45 and 46. The opening of switch 47 which results from the user maintaining pressure upon button 24 in the manner described above in FIG. 1 isolates motor 71 from the electrical power applied to contacts 34 and 35. As a result, motor 71 is not energized during the charging process and the maximum charging speed occurs as energy flows to capacitors 45 and 46 from charger 50 (seen in FIG. 1).

Once capacitors 45 and 46 have been sufficiently charged, the user removes charger 50 in the manner described above in FIG. 1 and thereafter launches toy airplane 10 in the manner described in FIG. 2. As the user releases button 24 (seen in FIG. 2), switch 47 returns to its closed position which couples capacitors 45 and 46 to motor 71 energizing motor 71 and rotating propeller 43 (seen in FIG. 2). Thereafter, the toy airplane carries forward in flight as the energy within capacitors 45 and 46 powers the rotation of motor 71 to propel the toy airplane. Once the charge in capacitors 45 and 46 has been exhausted, motor 71 is without power and the toy airplane simply glides back to earth.

What has been shown is a toy airplane capable of flight which utilizes an electric motor and capacitor power source. The power source is quickly and easily recharged utilizing a switching arrangement to maximize the speed of recharging and to minimize the loss of energy during the charging process. The toy airplane is configured to resemble a flying wing and defines a slot within which a propeller is rotated to provide propulsion. A shroud encircles the propeller slot to protect the propeller from damage and to maintain a safety shield for the user.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy airplane comprising:

an airplane body having wings and defining a charger receptacle;

a propulsion unit supported within said airplane body having a motor and propeller rotated by said motor, a capacitor storage unit, a pair of contacts supported within said receptacle and a switch, said contacts being coupled to said capacitor storage unit and said switch having an open condition and a closed condition coupling said motor to said capacitor storage unit in its closed condition and decoupling said motor in its open condition;

a charger unit having a battery power supply and contact means for temporarily connecting to said pair of contacts to transfer energy from said battery power supply to said capacitor storage unit; and a launcher button operatively coupled to said switch, said switch being opened as said button is pressed during charging of said capacitor storage unit to maximize energy transfer between said battery power supply and said capacitor storage unit by decoupling said motor and said button being released as said toy airplane is launched;

said body defining a downwardly extending landing skid and said launcher button being supported by said skid.

2. The toy airplane set forth in claim 1 wherein said body defines a slot and wherein said propeller is supported for rotation within said slot.

3. The toy airplane set forth in claim 2 further including a generally cylindrical propeller shroud encircling said propeller.

4. A toy airplane comprising:

a body having a pair of wings and a fuselage, said fuselage defining a charger receptacle;

a pair of contacts supported within said receptacle;

a pair of series coupled capacitors coupled to said contacts;

a motor and propeller supported by said fuselage;

a switch having depressible button for actuating said switch for operatively connecting said motor to said pair of capacitors; and charging means having a battery supply and a head for engaging said receptacle and for electrically connecting said battery supply to said pair of contacts, said switch being opened by depressing said button as said toy airplane is held to disconnect said motor from said pair of capacitors and closed upon release to connect said motor to said at least one capacitor;

said body including a downwardly extending landing skid having said depressible button supported thereon.

* * * * *